United States Patent [19]

Osterhout et al.

[11] Patent Number: 5,019,951

[45] Date of Patent: May 28, 1991

[54] SPOTLIGHT WITH ADJUSTABLE HANDLE

[75] Inventors: Ralph F. Osterhout, San Francisco; Peter M. Fogg, Burlingame, both of Calif.

[73] Assignee: Rayovac Corporation, Madison, Wis.

[21] Appl. No.: 442,280

[22] Filed: Nov. 28, 1989

[51] Int. Cl.[5] ..... F21L 15/20

[52] U.S. Cl. ..... 362/191; 362/208; 362/399

[58] Field of Search ..... 362/190, 191, 109, 208, 362/285, 399, 427

[56] References Cited

U.S. PATENT DOCUMENTS

| | | | |
|---|---|---|---|
| 1,667,343 | 4/1928 | Bronson | 362/208 |
| 1,673,930 | 6/1928 | Anglada | 362/399 |
| 1,832,563 | 11/1931 | Kuch | 362/208 |
| 1,832,564 | 11/1931 | Kuhn | 362/208 |
| 2,053,591 | 9/1936 | Wiley | 362/208 |
| 2,628,305 | 2/1953 | Talbot et al. | 362/208 |
| 3,075,069 | 1/1963 | Spadaro | 362/399 |
| 3,398,271 | 8/1968 | Sakamoto | 362/158 |
| 3,794,825 | 2/1974 | Krupansky | 362/158 |
| 4,129,899 | 12/1978 | Dunbar | 362/109 |
| 4,233,655 | 11/1980 | Zelina, Jr. et al. | 362/399 |
| 4,339,788 | 7/1982 | White et al. | 362/205 |
| 4,345,304 | 8/1982 | Penney et al. | 362/205 |
| 4,364,104 | 12/1982 | Holahan et al. | 362/208 |
| 4,502,103 | 2/1985 | Collins | 362/225 |
| 4,535,397 | 8/1985 | May | 362/369 |
| 4,734,832 | 3/1988 | Moriano et al. | 362/399 |
| 4,800,472 | 1/1989 | Burton et al. | 362/158 |
| 4,896,253 | 1/1990 | Southworth | 362/109 |

*Primary Examiner*—Ira S. Lazarus
*Assistant Examiner*—Richard R. Cole
*Attorney, Agent, or Firm*—Kenyon & Kenyon

[57] ABSTRACT

A hand-held spotlight includes a beam enclosure having a pivotally-attached handle. The handle may be rotated between a first position corresponding to a lantern-style grip and a second position corresponding to a pistol-style grip.

8 Claims, 2 Drawing Sheets

SPOTLIGHT WITH ADJUSTABLE HANDLE

BACKGROUND OF THE INVENTION

1. Field of the Invention

The present invention relates generally to spotlights and other hand-held lighting devices and in particular to a spotlight having an attached handle which can be shifted between a lantern-style grip and a pistol-style grip.

Hand-held spotlights are generally available in either of two styles. In a first style, the spotlight includes a beam enclosure and a handle attached to the beam enclosure, where the handle is oriented in a direction parallel to the beam produced by the beam enclosure. This configuration, referred to as "lantern-style," allows the user to carry the spotlight with the beam enclosure below the handle in a manner similar to that of a traditional lantern. In a second style, the handle is oriented radially from the beam enclosure in a direction normal to the beam direction. Such a configuration, referred to as "pistol-style," allows the user to hold the spotlight upright in a manner similar to a pistol, facilitating aiming the beam in a desired direction.

It would be desirable to provide spotlight constructions which can assume either the lantern-style or the pistol-style configuration. One approach for achieving such a dual-configuration spotlight is described in U.S. Pat. No. 4,734,832, to Moriano et al. The spotlight is provided with a pair of interchangeable handles which are separately attached to a beam enclosure. Although quite workable, the use of interchangeable handles is disadvantageous in several respects. First, the need to manufacture separate handles increases the manufacturing cost of the spotlight. Second, and more important, it is difficult to keep track of the handle which is not attached to the beam enclosure. Thus, when the time comes for a user to interchange the handles, it is often difficult or impossible to locate the second handle. Third, interchanging of the handles can be problematic.

For these reasons, it is an object of the present invention to provide hand-held spotlights which can assume either a lantern-style or pistol-style configuration. A particular object of the present invention is that the transition between the two configurations can be achieved without the interchange of separate handles. Even more particularly, it is an object of the present invention to provide a spotlight construction having a single handle attached to the beam enclosure, where the handle can be shifted between a lantern-style orientation and a pistol-style orientation.

2. Description of the Background Art

U.S. Pat. No. 4,734,832 is discussed above. Hand-held spotlights having lantern-style grips are described in U.S. Pat. Nos. 4,345,304; 4,339,788; and 3,794,825. Hand-held spotlights having pistol-style grips are described in U.S. Pat. Nos. 4,535,397; 4,233,655; and 3,398,271.

SUMMARY OF THE INVENTION

According to the present invention, a hand-held light includes an enclosure and means within the enclosure for projecting a light beam along a preselected beam path. The handle is pivotally attached to the beam enclosure and is shiftable between a first position where the handle is parallel to the beam path (corresponding to a lantern-style configuration) and a second position where the handle is normal to the beam path (corresponding to a pistol-style configuration). Usually, the first and second positions are defined by a spring-loaded detent mechanism which fixes the handle position relative to the beam enclosure. The user is thus able to convert the hand-held light from one configuration to the other simply by pivoting the handle between positions.

In a particular embodiment, the handle is attached to the beam enclosure through an attachment member formed externally on the enclosure. The attachment member includes a bearing surface which is inclined at about 45° relative to the direction of the beam path. The handle also includes a bearing surface at one end thereof. The bearing surface is oriented at about 45° relative to its length (axial direction). By joining the handle to the attachment member through the bearing surfaces, the handle will be able to rotate about a pivotal axis normal to the plane of the bearing surfaces. Detents will be provided to selectively hold the handle in either the lantern-style configuration or pistol-style configuration. Conveniently, the detent mechanism comprises a spring coaxially mounted about a pivot pin and detent members formed on the opposed bearing surfaces. The handle may thus be moved by separating the bearing surfaces against the spring action and rotating the handle until the detents are engaged in the alternate configuration.

DESCRIPTION OF THE SPECIFIC EMBODIMENTS

Figure 1:
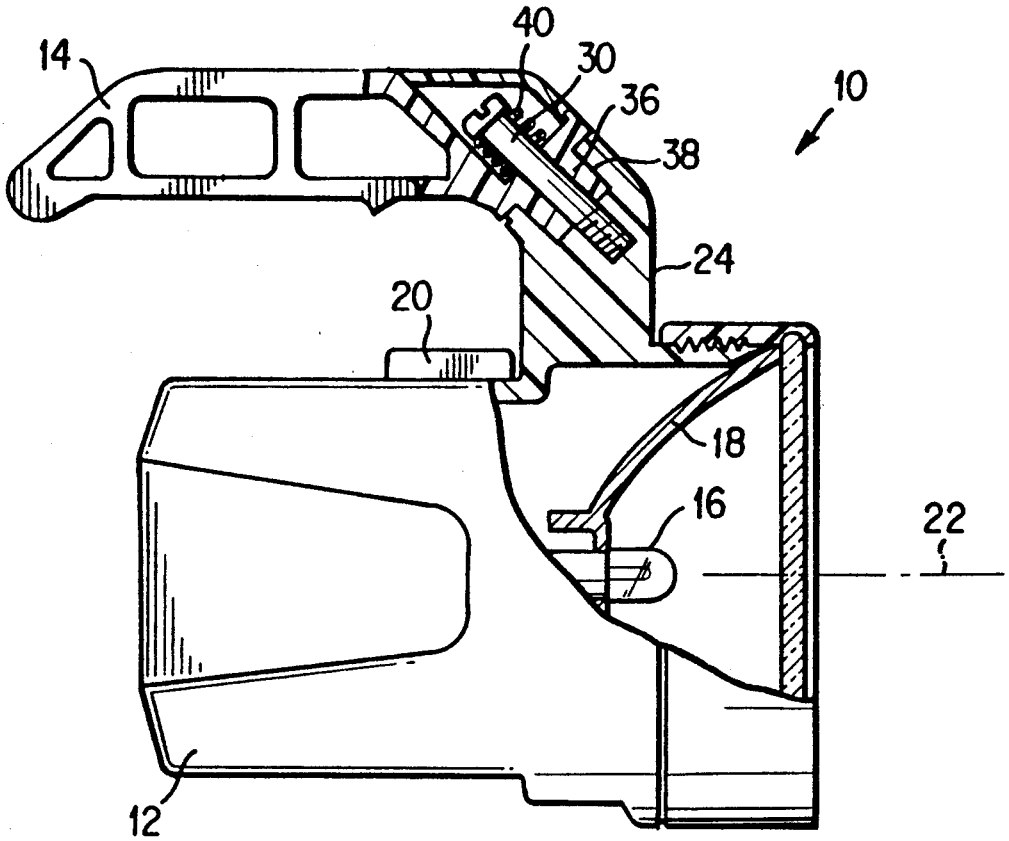
FIG. 1 is a front elevational view of a hand-held spotlight according to the present invention, with the handle in a lantern-style configuration.
Figure 2:
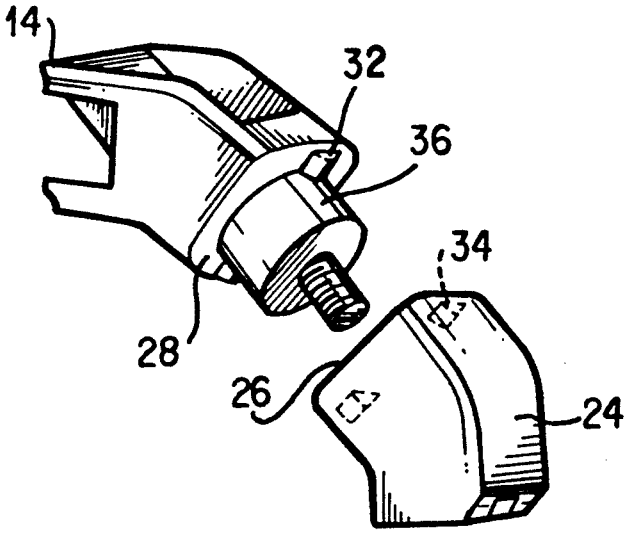
FIG. 2 is a detail view of the bearing surfaces of the handle and attachment member which provide for the pivotal mounting of the handle.
Figure 3:
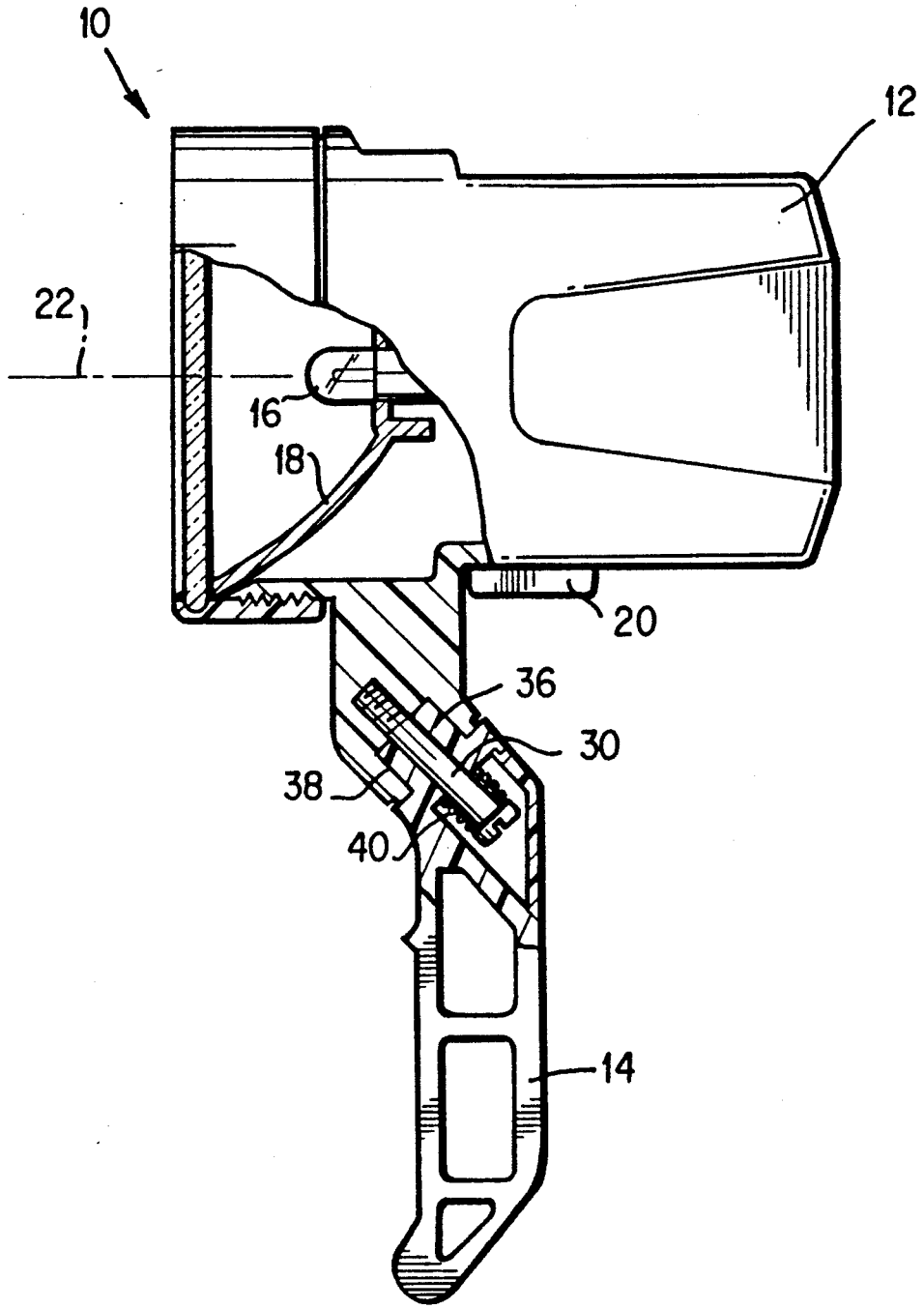
FIG. 3 is a front elevational view of a hand-held spotlight similar to that of FIG. 1, except that the handle has been rotated into the pistol-style configuration.

Referring to FIGS. 1–3, a hand-held spotlight 10 constructed in accordance with the principles of the present invention includes a beam enclosure 12 and a pivotable handle 14. The beam enclosure 12 includes a light beam projector, typically comprising a light bulb 16 and a parabolic reflector 18. Additionally, a switch 20, batteries (not illustrated) and internal wiring (not illustrated) will be provided to allow a user to turn off and on the light 16 using the switch. The beam enclosure 12 will thus be a self-contained assembly capable of projecting a light beam along an axial beam path 22. The construction of such a beam enclosure is generally conventional, as typified by the various patents cited hereinabove.

The pivotable handle 14 may be shifted between an orientation parallel to beam path 22 (as illustrated in FIG. 1) and a position normal to beam path 22 (as illustrated in FIG. 3). The handle 14 is attached to beam enclosure 12 through attachment member 24 formed externally on the enclosure 12. As illustrated, the attachment member 24 is integral with the main body of enclosure 12, but the attachment member may also be formed separately from the enclosure.

Referring now in particular to FIG. 2, attachment member 24 includes a bearing surface 26 which is inclined at an angle of about 45° relative to the direction of beam path 22. A second bearing surface 28 is formed at the end of handle 14 which is joined to the attachment member 24. Bearing surface 28 is inclined at an angle of approximately 45° relative to the length (axial direction) of handle 14. Thus by joining the handle 14 to the attachment member 24 with bearing surface 28 disposed against bearing surface 26, the handle 14 may be rotated into either the position illustrated in FIG. 1 (corresponding to a lantern-style grip) or the position illustrated in FIG. 3 (corresponding to a pistol-style grip). Conveniently, a pivot pin 30 (FIGS. 1 and 3) is provided to allow the pivotal rotation of the handle relative to the enclosure 12.

In order to selectively secure the handle 14 in either the lantern-style configuration or the pistol-style configuration, a detent mechanism comprising a pair of detent members 32 (only one of which is illustrated in FIG. 2) and detent receptacles 34 (also only one of which is illustrated in FIG. 2) are provided on the bearing surfaces 26 and 28, respectively. A male member 36 is provided on the bearing surface 28 and received by a female receptacle 38 formed in the attachment member 24. Spring member 40 is provided about the pivot pin, as best observed in FIGS. 1 and 3. The detents 32 and detent receptacles 34 will be able to hold the handle 14 in either of the desired configurations, while the handle may be pulled away to separate the detent mechanism to allow the handle to rotate between the configurations. As the handle 14 is pulled away, spring member 40 will be compressed between the head of pivot member 30 and the interior of handle 14. The handle will then be able to pivot around the male member 36 and pivot member 30 by applying a simple manual turning action. As the handle approaches the alternate configuration, the detents 32 and receptacles 34 will automatically fall in place under the force of spring member 40.

Although the foregoing invention has been described in detail for purposes of clarity of understanding, it will be obvious that certain modifications may be practiced within the scope of the appended claims.

What is claimed is:

1. A hand-held light comprising:

an enclosure, said enclosure defining a longitudinal axis and being configured to contain a source of electrical power and at least one light bulb;

means in the enclosure for enabling the projection of a light beam along an axis generally parallel to the longitudinal axis of the enclosure;

a handle; and means for pivotally securing the handle to the enclosure, whereby the handle may be shifted between a first position generally parallel to the longitudinal axis of the enclosure and located to one side of spaced apart from the enclosures, and a second position generally normal to the longitudinal axis of the enclosure.

2. A hand-held light as in claim 1, wherein the means for projecting a light beam includes a parabolic reflector disposed at one end of the enclosure.

3. A hand-held light as in claim 2, wherein the securing means is disposed at said one end of the enclosure.

4. A hand-held light as in claim 1, wherein the handle is secured about a pivotal axis which is oriented at a set angle of about 45° relative to the beam axis.

5. A hand-held light comprising:

an enclosure, said enclosure defining a generally longitudinal enclosure axis and being configured to contain a source of electrical power and at least one light bulb;

means in the enclosure for projecting a light beam along a preselected axis;

an attachment member fixed to the enclosure and having a bearing surface which is inclined at about 45° relative to the enclosure axis;

an elongate handle having at one end a bearing surface which is inclined at about 45° relative to the length of the handle; and a pin for pivotally attaching the handle to the attachment member so that the bearing surfaces thereof generally meet, whereby the handle may be pivoted between a first position where the length of the handle is generally parallel to the beam axis and a second position where said length is generally normal to the beam axis.

6. A hand-held light as in claim 5, further comprising mating detents on the bearing surfaces and a spring member allowing the surfaces to be pulled apart sufficiently to overcome the detents, wherein said detents define said first and second positions.

7. A hand-held light as in claim 5, wherein the means for projecting a light beam includes a parabolic reflector disposed at one end of the enclosure.

8. A hand-held light as in claim 7, wherein the attachment member is fixed to said one end of the enclosure.

* * * * *

UNITED STATES PATENT AND TRADEMARK OFFICE

CERTIFICATE OF CORRECTION

PATENT NO. : 5,019,951

DATED : May 28, 1991

INVENTOR(S) : Ralph F. Osterhout, etal

It is certified that error appears in the above-identified patent and that said Letters Patent is hereby corrected as shown below:

Column 4 line 9, before "spaced" insert --and --.

Column 4 line 10,change "enclosures" to --enclosure--.

Signed and Sealed this

Eighth Day of December, 1992

*Attest:*

DOUGLAS B. COMER

*Attesting Officer*

*Acting Commissioner of Patents and Trademarks*